United States Patent [19]

Nunziato

[11] 3,981,507

[45] Sept. 21, 1976

[54] GOLF CLUB HEAD CONSTRUCTION

[76] Inventor: Charles Nunziato, Rte. No. 1, Westville, Fla. 32464

[22] Filed: July 22, 1974

[21] Appl. No.: 490,869

[52] U.S. Cl. ..... 273/164; 273/167 A

[51] Int. Cl.[2] ..... A63B 53/04

[58] Field of Search ..... 273/67 R, 77 R, 78, 273/79, 80 C, 164, 167–174

[56] References Cited

UNITED STATES PATENTS

| | | | |
|---|---|---|---|
| 645,944 | 3/1900 | Dalgleish | 273/174 X |
| 786,268 | 4/1905 | Corey et al. | 273/168 |
| 1,336,671 | 4/1920 | Backus | 273/167 E |
| 1,511,479 | 10/1924 | Kelly et al. | 273/168 X |
| 2,336,405 | 12/1943 | Kent | 273/79 |
| 3,088,736 | 5/1963 | Mospan | 273/167 A X |
| 3,392,977 | 7/1968 | DeLacey | 273/168 X |
| 3,397,888 | 8/1968 | Springer et al. | 273/168 X |
| 3,486,755 | 12/1969 | Hodge | 273/164 |
| 3,572,709 | 3/1971 | Risher | 273/167 K X |
| 3,901,514 | 8/1975 | Priaulx | 273/168 |
| D179,002 | 10/1956 | Hoffmeister | 273/164 X |
| D193,897 | 10/1962 | Vachon | 273/168 UX |
| D209,149 | 11/1967 | Sowers | 273/164 UX |
| D213,382 | 2/1969 | Risher | D34/5 GH |
| D219,156 | 11/1970 | Risher | D34/5 GH |
| D229,431 | 11/1973 | Baker | D34/5 GH |

FOREIGN PATENTS OR APPLICATIONS

| | | | |
|---|---|---|---|
| 1,063,798 | 3/1967 | United Kingdom | 273/167 A |
| 5,739 | 3/1910 | United Kingdom | 273/167 J |
| 15,597 | 7/1904 | United Kingdom | 273/80 C |

*Primary Examiner*—Richard J. Apley
*Attorney, Agent, or Firm*—Clarence A. O'Brien; Harvey B. Jacobson

[57] ABSTRACT

A golf club is provided and includes an upstanding shank portion and a lower head portion carried by the lower end of the shank portion. The head includes top, bottom, front, rear and inner and outer sides and the shank portion extends upwardly from the head at a point on the top side thereof adjacent the front and inner sides of the head at an angle upwardly and outwardly inclined from the inner side of the head. The inner and outer sides generally parallel each other and the outer side, rear and top sides are substantially mutually right-angularly disposed. The front side or face is rearwardly and upwardly inclined and the bottom side of the head is slightly convex with the axis of curvature thereof disposed in a vertical plane extending at generally right angles to a vertical plane containing the shaft portion of the club.

1 Claim, 6 Drawing Figures

GOLF CLUB HEAD CONSTRUCTION

BACKGROUND OF THE INVENTION

The golf club of the instant invention is constructed in a manner whereby the front face thereof has greater surface area and due to the greater surface area of the front or ball striking face of the club the club may strike an associated golf ball in slightly off-center position without adversely affecting the subsequent flight of the ball. As a result, a golfer may swing more freely and with greater power with the assurance that at least some portion of the front ball striking face of the club head will impact with the ball and the subsequent flight of the ball will be of greater duration due to the faster swing imparted to the club head.

Club heads have been heretofore designed so as to provide generally square or at least rectangular front or ball striking faces. Examples of such clubs may be found in U.S. Pat Nos. 749,174, 1,334,189, 1,618,640 and 3,397,888. Additional examples of similar club heads may be found in U.S. Design Pat. Nos. 192,473, 202,504 and 204,000.

BRIEF DESCRIPTION OF THE INVENTION

The club head of the instant invention presents a generally rectangular ball striking front face of relatively large surface area in order that a golfer may swing more freely and with greater power during a golf shot with substantially complete assurance that a slightly off-center strike of the front face of the club against an associated ball will not adversely affect the subsequent flight of the ball.

The main object of this invention is to provide a golf club for use in driving a golf ball and constructed in a manner whereby a golfer may swing more freely with reduced apprehension about the strike of the front face of the club head being off-center to the extent that the subsequent flight of the ball is adversely affected.

Another object of this invention, in accordance with the immediately preceding object, is to provide a golf club constructed in a manner whereby a golfer may swing during a tee shot with greater force.

Yet another object of this invention is to provide a golf club including a convex undersurface or lower face whose axis of curvature extends in a front-to-rear direction relative to the golf club head.

A final object of this invention to be specifically enumerated herein is to provide a golf club which will conform to conventional forms of manufacture, be of simple construction and dependable in use so as to provide a device that will be economically feasible, long lasting and an aid to both beginning and established golfers.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
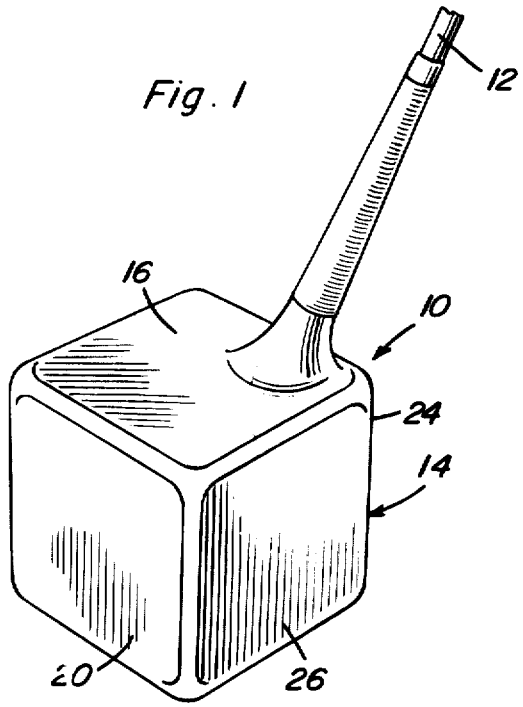
FIG. 1 is a fragmentary perspective view of the lower end of a club constructed in accordance with the instant invention.
Figure 2:
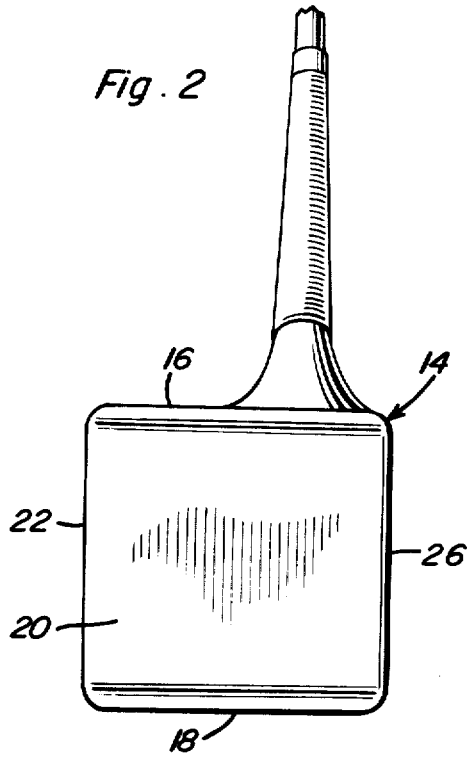
FIG. 2 is a side elevational view of the club as seen from the left side of FIG. 1.

Referring now more specifically to the drawings the numeral 10 generally designates a first form of golf club constructed in accordance with the present invention. The golf club 10 includes the usual shank portion or shaft 12 and an enlarged head referred to in general by the reference numeral 14 on the lower end of the shank or shank portion 12.

The head 14 includes generally parallel top and bottom surfaces or faces 16 and 18, an outer side face 20, a rear face 22, an inner side face 24 and a front face 26.

The lower end of the shank portion 12 projects upwardly from the upper face or surface 16 adjacent the front and inner side faces 26 and 24 of the head 14. The various edges and corners of the head 14 are radiused to a slight degree and the front face 16 is slightly rearwardly and upwardly inclined. The shank portion 12 is inclined upwardly and outwardly of the inner side face 24 of the head 14 and disposed in a vertical plane extending transversely through the head 14.

Figure 3:
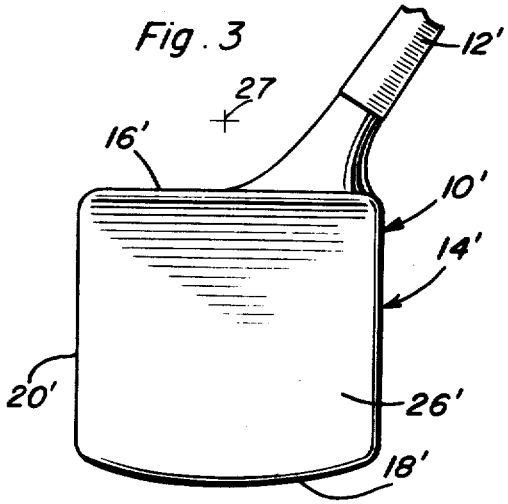
FIG. 3 is a fragmentary front elevational view of a modified form of club.
Figure 4:
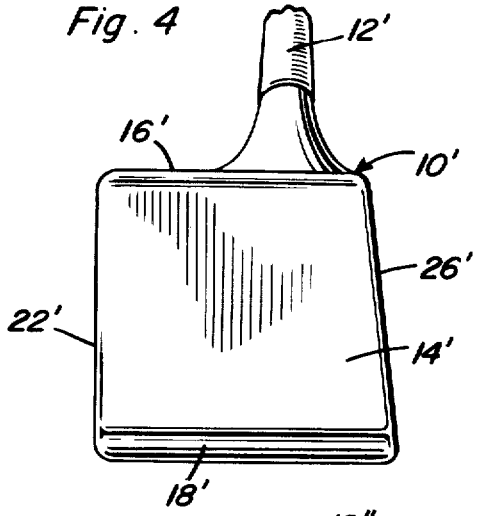
FIG. 4 is a side elevational view of the modified form of club as seen from the left side of FIG. 3.

With attention now invited more specifically to FIGS. 3 and 4 of the drawings there may be seen a second form of golf club referred to in general by the reference numeral 10' and which is similar to the club 10 and has its various surfaces and structural features referred to by prime reference numerals corresponding to the numerals applied to the corresponding surfaces and features of the club 10.

The differences between the club 10' and the club 10 are that the front face 26' of the club 10' is slightly more rearwardly and upwardly inclined than the front face 26. In addition, the undersurface or face 18' of the club 10' is convex and has its axis of curvature spaced above the upper surface 16' as at 27 extending in a front-to-rear direction relative to the front and rear faces 26' and 22' of the nead 14'.

Figure 5:
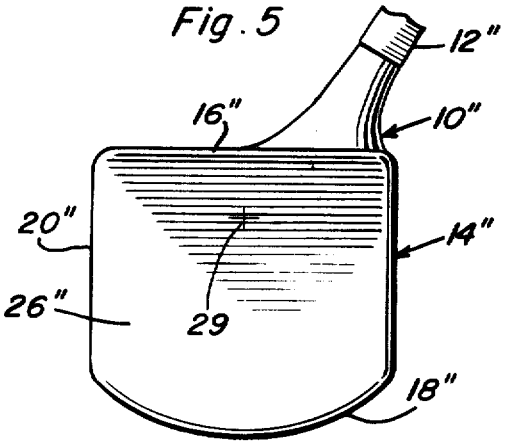
FIG. 5 is a fragmentary front elevational view of a second modified form of club.
Figure 6:
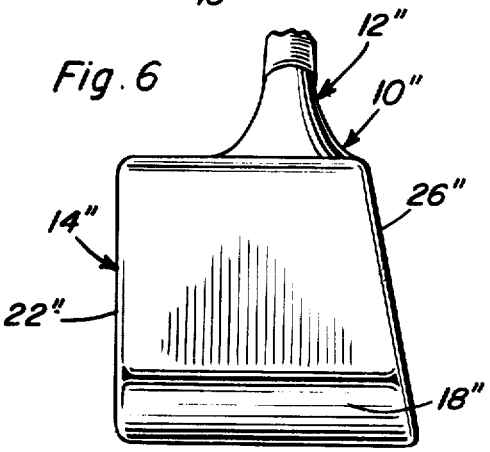
FIG. 6 is a side elevational view of the second modified form of club as seen from the left side of FIG. 5.

With reference now more specifically to FIGS. 5 and 6 of the drawings there may be seen a third form of golf club referred to in general by the reference numeral 10'' and which also has its various surfaces and features referred to by double prime reference numerals corresponding to the reference numerals applied to the various similar surfaces and features of the club 10.

The club 10'' differs from the clubs 10 and 10' in that the front face 26'' of the club 10'' is inclined rearwardly and upwardly more than ten degrees relative to the vertical plane containing the shank portion 12'', a greater degree than the rearward and upward inclination of the front face 26' of the club 10'. Also, the lower or undersurface 18'' of the head 14'' is more greatly cylindrically convexed than the undersurface 18' of the head 14' and the axis of curvature of the undersurface 18'' is designated by the reference numeral 29 and spaced below the upper surface 16'' of the head 14''. However, the axis of curvature of the underface or surface 18'' also extends in a front-to-rear direction in relation to the front and rear surfaces 22'' and 26'' of the head 14''.

The undersurface 18 of the head 14 need not be convexed inasmuch as the club 10 will be used in substantially all instances in conjunction with a teed golf ball. However, the convex undersurfaces 18' and 18'' of the heads 14' and 14'' lessen the tendency of a lower forward corner of the heads 14' and 14'' to dig into the ground when a ball supported from the ground is struck. Thus, there is little tendency for the heads 14' and 14'' to be canted in either direction as a result of a slightly lower than desired club head swing. Further, the longitudinal center axis of the shank portions 12, 12' and 12'' extend downwardly through the corresponding lower faces 18, 18' and 18'' so as to pass therethrough closely adjacent the outer marginal edges of the bottom surfaces 18, 18' and 18''.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf club including an upstanding shaft portion having an enlarged head supported from its lower end, said head including top and bottom sides, generally parallel opposite inner and outer sides and front and rear sides, said shaft portion being slightly upwardly and outwardly inclined from the inner side of said head and being joined to the top side of said head adjacent said front side and said inner side thereof, said outer, rear and top sides being substantially mutually right angularly disposed, said front side being at least slightly rearwardly and upwardly inclined relative to said rear side, said bottom side being cylindrically convex about a front-to-rear extending axis, the radius of curvature of said convex bottom side being less than the maximum spacing between said top and bottom sides and the spacing between said inner and outer sides, said front side being inclined more than ten degrees relative to a vertical plane containing said shaft portion.

* * * * *